US011771979B2

(12) United States Patent
Halldin

(10) Patent No.: US 11,771,979 B2
(45) Date of Patent: Oct. 3, 2023

(54) GLOVE

(71) Applicant: MIPS AB, Täby (SE)

(72) Inventor: Peter Halldin, Täby (SE)

(73) Assignee: MIPS AB

( * ) Notice: Subject to any disclaimer, the term of this patent is extended or adjusted under 35 U.S.C. 154(b) by 169 days.

(21) Appl. No.: 17/295,524

(22) PCT Filed: Nov. 20, 2019

(86) PCT No.: PCT/EP2019/081978
§ 371 (c)(1),
(2) Date: May 20, 2021

(87) PCT Pub. No.: WO2020/104550
PCT Pub. Date: May 28, 2020

(65) Prior Publication Data

US 2022/0008806 A1 Jan. 13, 2022

(30) Foreign Application Priority Data

Nov. 23, 2018 (GB) ..... 1819112
Jul. 15, 2019 (GB) ..... 1910118

(51) Int. Cl.
*A63B 71/14* (2006.01)
*A41D 19/015* (2006.01)

(52) U.S. Cl.
CPC ..... *A63B 71/141* (2013.01); *A41D 19/015* (2013.01); *A63B 2209/00* (2013.01)

(58) Field of Classification Search
CPC .. A63B 71/141; A63B 71/145; A41D 19/015; A41D 19/01523
See application file for complete search history.

(56) References Cited

U.S. PATENT DOCUMENTS 4,603,439 A * 8/1986 Golomb ..... A63B 71/145 2/18
5,407,685 A * 4/1995 Malchesky ..... A61L 11/00 424/404
6,658,671 B1 * 12/2003 Von Holst ..... A42B 3/064 2/412
6,704,936 B1 * 3/2004 Carlin ..... A63B 71/145 2/161.1
8,726,418 B2 * 5/2014 DeBlasis ..... A41F 1/06 2/161.1
10,561,192 B2 * 2/2020 Weber ..... A42B 3/064
11,523,645 B2 * 12/2022 Smid ..... A41D 19/01547
(Continued)

FOREIGN PATENT DOCUMENTS

AU 2011100503 A4 6/2011
FR 2780292 A1 12/1999
WO 2017075671 A1 5/2017

*Primary Examiner* — Khaled Annis
(74) *Attorney, Agent, or Firm* — Perkins Coie LLP

(57) ABSTRACT

According to an aspect of the invention there is provided a combat sports glove comprising: an inner layer configured to accommodate a wearer's hand; an outer layer covering at least a part of the inner layer; a padding layer between the inner and outer layers, configured to absorb energy of an impact between the glove and an object; and a sliding interface between the inner layer and the outer layer at which the inner layer and the outer layer are configured to slide relative to each other in response to an impact between the glove and an object.

15 Claims, 8 Drawing Sheets

(56) References Cited

U.S. PATENT DOCUMENTS

| | | | | |
|---|---|---|---|---|
| 2005/0066411 | A1* | 3/2005 | Matechen | A41D 19/01523 2/161.1 |
| 2012/0227157 | A1* | 9/2012 | Kleinert | A41D 13/081 2/161.1 |
| 2014/0031180 | A1* | 1/2014 | Jones | A63B 21/00065 482/111 |
| 2014/0143924 | A1 | 5/2014 | Rusakov et al. | |
| 2017/0282048 | A1* | 10/2017 | Wittman | A63B 71/145 |
| 2019/0176014 | A1* | 6/2019 | Chen | A41D 19/01523 |
| 2019/0289931 | A1* | 9/2019 | Chen | A41D 13/015 |
| 2019/0328062 | A1* | 10/2019 | Kamphuis | A41D 19/01588 |
| 2020/0022435 | A1* | 1/2020 | Berger | A41D 19/01523 |
| 2020/0245710 | A1* | 8/2020 | Zhou | B29C 43/34 |

* cited by examiner

GLOVE

RELATED APPLICATIONS

This application is a 35 USC § 371 National Stage application of International Application No. PCT/EP2019/081978, entitled "GLOVE," filed on Nov. 20, 2019, which claims the benefit of United Kingdom Patent Application No. 1819112.2, filed on Nov. 23, 2018 and United Kingdom Patent Application No. 1910118.7, filed on Jul. 15, 2019, the disclosures of which are incorporated herein by reference in their entirety.

The present invention relates to a glove, in particular a glove for combat sports including but not limited to boxing, Muay Thai and mixed martial arts.

Combat sports that involve striking an opponent have the potential to cause serious injury. To mitigate some of the risk of injury, competitors may wear gloves designed to absorb some of the impact of a punch. Gloves typically include padding designed to deform on impact to absorb some of the energy of a punch. One example of such a glove is a boxing glove.

Gloves used in combat sports are better at protecting against an axial component of a punch, passing through the centre of gravity of the head, than a tangential component of a punch that causes the head to rotate. During an oblique impact, tangential force components may be exerted on the receiver of a punch. In the case of an oblique impact on a receiver's head, this may result in angular acceleration of the head. Angular acceleration of the head causes the brain to rotate within the skull, creating injuries on bodily elements connecting the brain to the skull and also to the brain itself.

Examples of rotational injury include subdural haematomas, bleeding as a consequence of blood vessels rupturing, and diffuse axonal injuries, which can be summarised as nerve fibres being overstretched as a consequence of high shear deformations in the brain tissue. Dependent on the characteristics of the rotational force, such as the duration, amplitude and rate of increase, either subdural haematomas or diffuse axonal injuries occur, or a combination of these is suffered. Generally speaking, subdural haematomas occur in the case of short duration and great amplitude rotational accelerations, while diffuse axonal injuries occur in the case of longer and more widespread acceleration loads. In addition, rotational injuries can include less severe injuries such as concussion.

The present invention aims to at least partially address some of the problems discussed above.

According to an aspect of the invention there is provided a combat sports glove, e.g. a boxing, Muay Thai, or mixed martial arts glove, comprising: an inner layer configured to accommodate a wearer's hand; an outer layer covering at least a part of the inner layer; a padding layer between the inner and outer layers, configured to absorb and/or redirect energy of an impact between the boxing glove and an object and a sliding interface between the inner layer and the outer layer at which the inner layer and the outer layer are configured to slide relative to each other in response to an impact between the boxing glove and an object.

Optionally, at least one of the inner and outer layers is formed from an elastic material configured to stretch elastically in response to an impact between the glove and an object to allow the inner layer and the outer layer to slide relative to each other.

Optionally, the inner and outer layers are connected by an elastic connecting means configured to stretch elastically in response to an impact between the glove and the object to allow the inner layer and the outer layer to slide relative to each other.

Optionally, the sliding interface comprises an intermediate layer formed from a material selected such that there is low friction between the intermediate layer and at least one adjacent layer.

Optionally, the sliding interface comprises first and second intermediate layers, arranged adjacent each other and each formed from a material selected such that there is low friction at least between the first and second intermediate layers.

Optionally, the sliding interface comprises a modification of the surface of at least one of the inner, outer and padding layers such that there is low friction between that surface and an adjacent layer. Optionally, said modification of the surface comprises the use of a different substance from that used to form the inner, outer or padding layer, impregnated into the surface of the inner, outer or padding layer or bonded to the inner, outer or a padding layer. Optionally, said modification of the surface comprises a physical treatment to the surface of at least one of the inner, outer, and padding layers in order to change the mechanical properties of the surface of the layer.

Optionally, the sliding interface is provided between the outer layer and the padding layer. Alternatively, or additionally, the sliding interface is provided between the inner layer and the padding layer. Alternatively, or additionally, the padding layer comprises first and second padding layers and the sliding interface is provided between the first and second padding layers.

Optionally, the inner layer has a multi-layered structure and the sliding interface is provided between respective layers of the inner layer.

Optionally, the outer layer has a multi-layered structure and the sliding interface is provided between respective layers of the outer layer.

Optionally, the padding layer comprises a plurality of padding segments, each padding segment being configured to slide relative to the inner and/or outer layers at a sliding interface and each padding segment being configured to slide independently of each other padding segment.

Optionally, the outer layer comprises a plurality of outer layer segments, each outer layer segment being configured to slide relative to the padding and/or inner layers at a sliding interface and each outer layer segment being configured to slide independently of each other outer layer segment.

Optionally, the inner layer comprises a plurality of inner layer segments, each inner layer segment being configured to slide relative to the padding and/or outer layers at a sliding interface and each inner layer segment being configured to slide independently of each other inner layer segment.

Optionally, the outer layer comprises a plurality of outer plates, the outer plates being mounted on the padding layer such that, under an impact to an outer plate, the outer plate can slide across the relatively padding layer and move relative to other outer plates.

Optionally, the glove may comprise a fluid filled envelope between the inner and outer layers configured to provide the sliding interface.

The invention will now be described by way of non-limiting examples, with reference to the accompanying drawings, in which.

Figure 1:
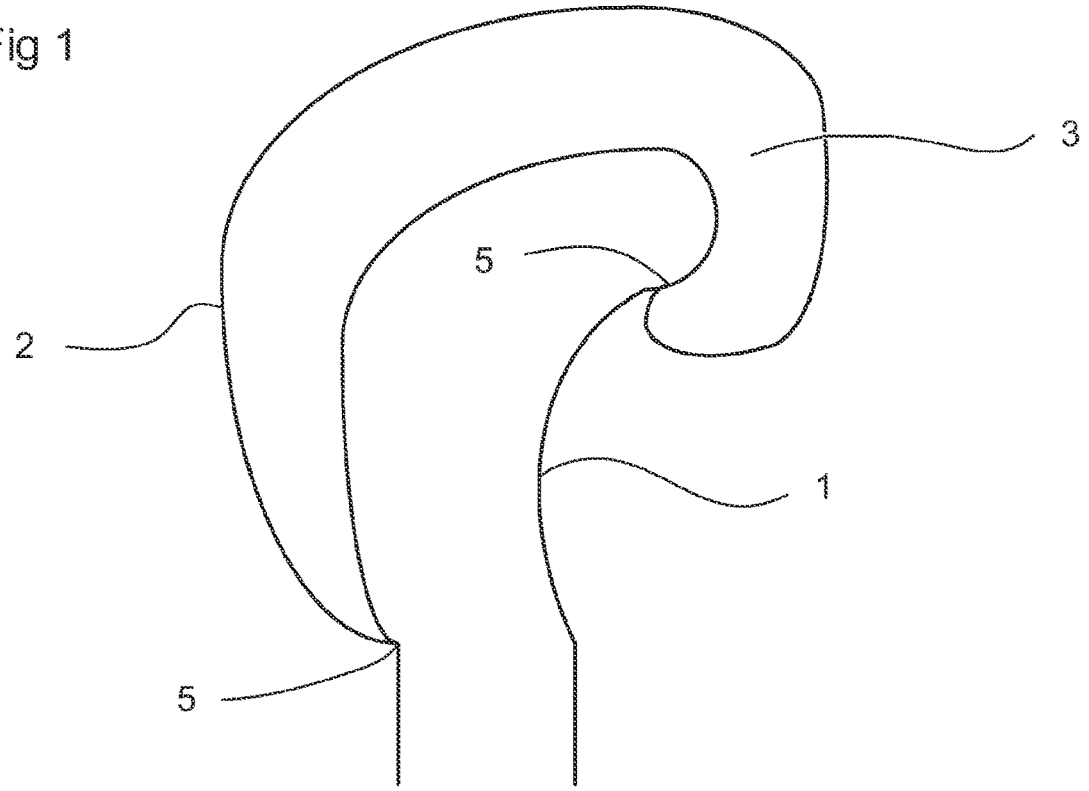
FIG. 1 depicts a cross-section of a first example glove.

A first example glove is shown in FIG. 1 and comprises an inner layer 1 configured to accommodate a wearer's hand. Accordingly, the inner layer 1 defines a cavity within which a hand can be inserted. Covering at least a part of the inner layer 1 is an outer layer 2. Between the inner and outer layers 1, 2 is a padding layer 3. The padding layer is configured to absorb and/or redirect energy of an impact between the glove and an object. The inner and outer layers may be connected at one or more seams 5, e.g. by stitching.

The inner and outer layers 1, 2 may, for example, be formed from a textile, a cloth and/or a fabric. However, other materials may also be used, including felts and directly-formed flexible sheet materials including, for example, leather and artificial leather.

It should be appreciated that the first and second layers may be formed from different materials and/or different types of material. The layer of material to be provided on the inside of the glove may be selected for one particular quality, such as comfort for the wearer, while a second material may be selected for the layer to be formed on the outside of the glove, for example for its appearance, wear resistance, and/or water resistance. Both layers may be formed from the same material.

As shown in FIG. 1, the padding layer 3 may be configured to cover the knuckles of the wearer. The padding layer 3 may further be configured to cover the rest of the fingers of the wearer. The padding layer 3 may be formed from any suitable energy absorbing material. For example, the padding may include horsehair padding, foam padding or a combination of both. Foam padding may comprise latex and/or PVC foam, for example.

Figure 3:
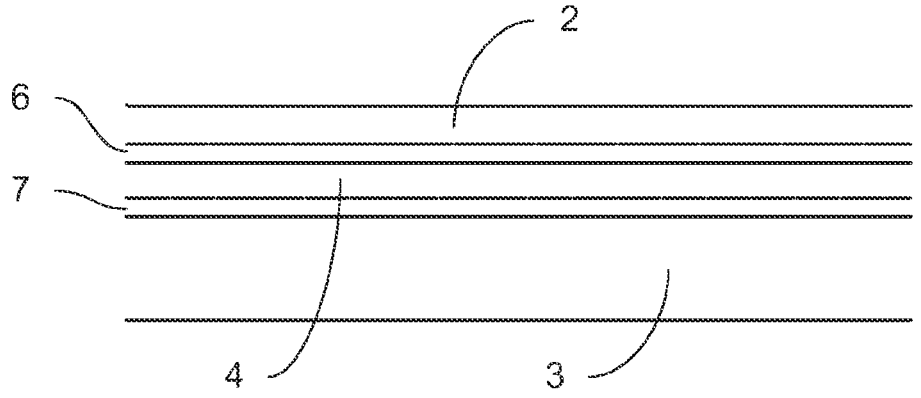
Figure 4:
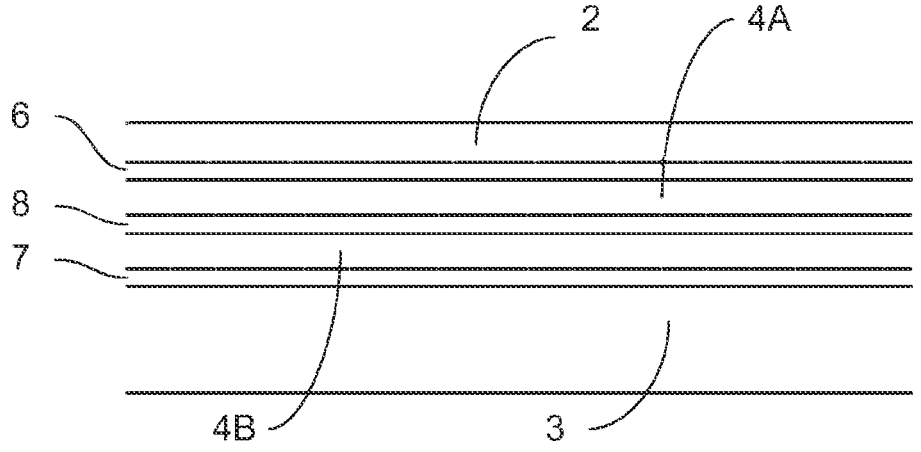
FIG. 4 depicts a cross-section of a portion of a glove.
Figure 5:
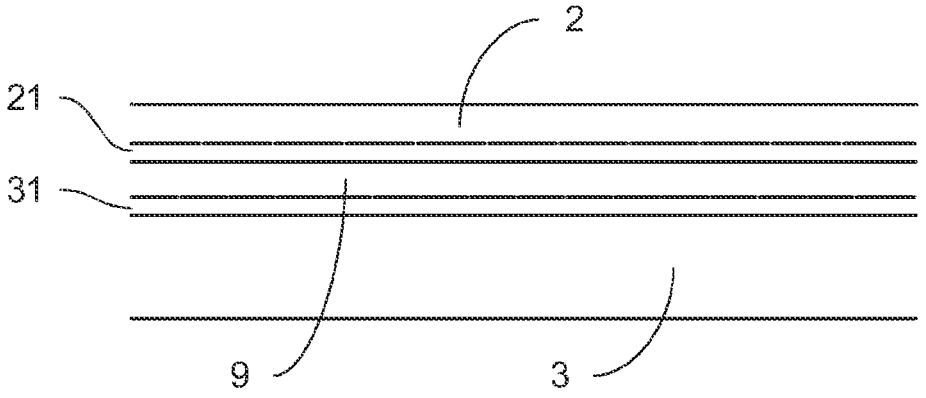
FIG. 5 depicts a cross-section of a portion of a glove.
Figure 6:
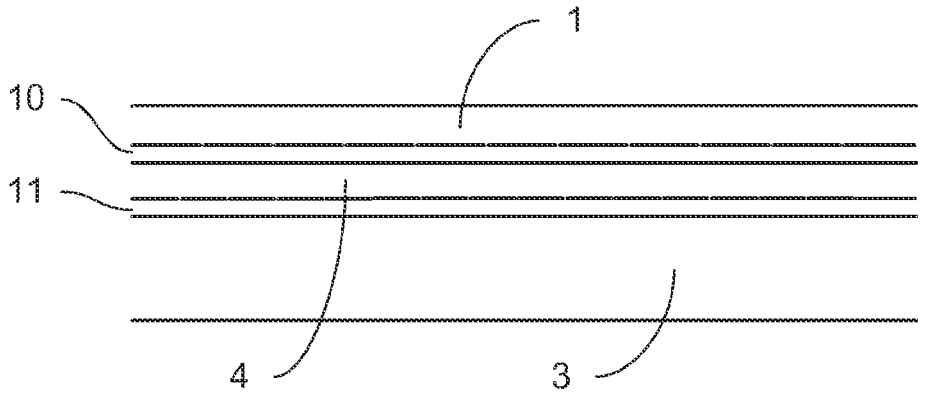
FIG. 6 depicts a cross-section of a portion of a glove.
Figure 7:
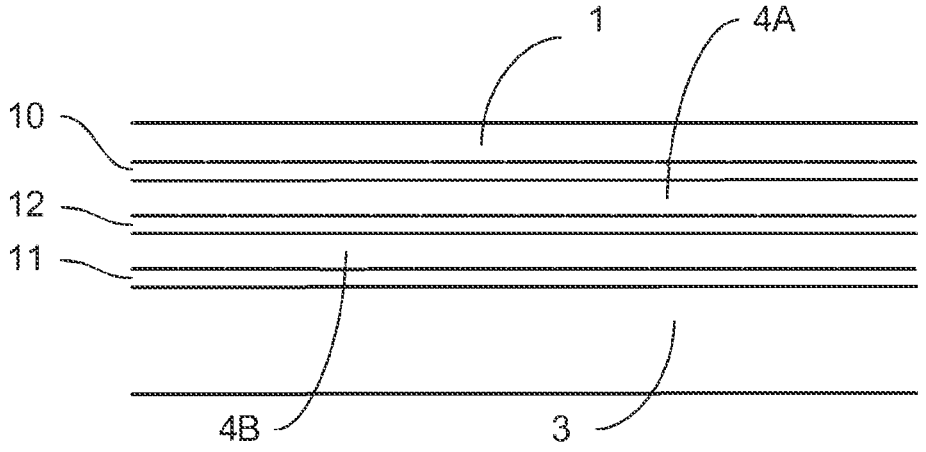
FIG. 7 depicts a cross-section of a portion of a glove.
Figure 8:
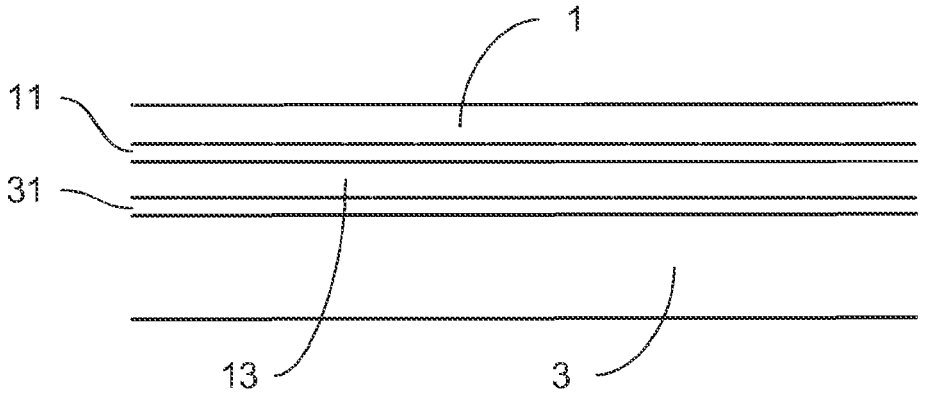
FIG. 8 depicts a cross-section of a portion of a glove.

The glove further comprises a sliding interface between the inner layer and the outer layer at which the inner layer and outer layer are configured to slide relative to each other in response to an impact between the glove and an object. This sliding mitigates the transmission of rotational forces on the object, caused by an oblique impact to the object, e.g. by redirecting the energy of an impact. Various examples of sliding interfaces for the glove depicted in FIG. 1 are shown in FIGS. 3 to 8 and are described below. In particular, FIGS. 3 to 5 depict sliding interfaces provided between the outer layer 2 and the padding layer 3, while FIGS. 6 to 8 depict sliding interfaces provided between the inner layer 1 and the padding layer 3. Sliding interfaces, such as those shown in FIGS. 3 to 8, may be provided between the outer layer 2 and the padding layer 3 and the inner layer 1 and the padding layer 3, within the same glove.

FIG. 3 depicts a first example of a glove with a sliding interface provided between the outer layer 2 and the padding layer 3. In order to provide the sliding interface, an intermediate layer 4 is provided between the outer layer 2 and the padding layer 3. The intermediate layer 4 may not be visible to the wearer of the glove. Accordingly, the intermediate layer 4 need not be formed from a material selected for qualities that may usually be desirable for material used to form a glove. The material forming the intermediate layer 4 may be selected in order to have low friction between the intermediate layer 4 and at least one of the outer layer 2 and padding layer 3 at the respective interface 6, 7 between the intermediate layer 4 and the outer layer 2 and/or padding layer 3. Such an arrangement enables sliding between the outer layer 2 and the padding layer 3, and therefore between the inner layer 1 and the outer layer 2.

It should be appreciated that, for clarity, in FIG. 3 a separation is shown between the layers 2, 3, 4, namely at the interfaces 6, 7. In practice these layers may be touching, at least in some regions, especially in use. In some arrangements, the intermediate layer 4 may be fixed to one of the adjacent layers and slide relative to the other.

FIG. 4 depicts an alternative arrangement of a sliding interface. As with the arrangement depicted in FIG. 1, a sliding interface is provided between the outer layer 2 and the padding layer 3. In this arrangement, the sliding interface is formed from first and second intermediate layers 4A, 4B provided between the outer layer 2 and the padding layer 3. In such an arrangement, the first and second intermediate layers 4A, 4B may be selected for the low friction between the first and second intermediate layers 4A, 4B, namely at the interface 8 between them. Alternatively and/or additionally, the interface 6 between the outer layer 2 and first intermediate layer 4A and/or the interface 7 between the padding layer 3 and the second intermediate layer 4B may be low friction.

In an arrangement such as that shown in FIG. 4, the first and second intermediate layers 4A, 4B, may be formed from the same material or may be formed from different materials. Further intermediate layers may also be included, either to further promote sliding between any adjacent pair of layers and/or to provide additional properties to the glove overall.

In the arrangements shown in FIG. 3 and FIG. 4 and discussed above, the intermediate layers 4, 4A, 4B, where used, may be formed from any suitable material. For example these layers may be formed from films of plastic that may be formed to have smooth surfaces. It should also be appreciated that the arrangements depicted in the Figures are schematic and, accordingly, the relative thicknesses of the different layers shown in the figures may not be representative.

FIG. 5 depicts a further arrangement for providing a sliding interface to the glove. In this arrangement, the sliding interface is formed by modifying the surface of at least one of the outer layer 2 and padding layer 3. The friction at the interface 9 in between the modified surface 21 of the outer layer 2 and the modified surface 31 of the padding layer 3 may be lower than the friction that would occur between the unmodified surfaces of the outer layer 2 and padding layer 3.

Depending on the modified surface, it may be sufficient that the surface of only one of the outer layer 2 and padding layer 3 be modified.

It should be appreciated that this arrangement may be combined with those discussed above, namely by providing one or more intermediate layers 4 between the modified surfaces 21, 31 of the outer layer 2 and padding layer 3 in order to promote further the low friction interface.

It should also be appreciated that instead of modifying the surfaces of the outer layer 2 and/or padding layer 3, the materials forming the outer layer 2 and/or padding layer 3 may be selected such that there is sufficiently low friction between the opposing surfaces of the outer layer 2 and padding layer 3 to provide a low friction interface.

A variety of modifications may be used in order to modify the surfaces 21, 31 of the outer layer 2 and padding layer 3. It should also be appreciated that a different modification may be used for the outer layer 2 from the modification used for the padding layer 3. By way of example, the surface of a layer may be modified by impregnating a different substance into the surface of the layer. Alternatively or additionally, a different substance may be bonded to the surface of the layer. Alternatively or additionally, a physical treatment may be applied to the surface of the layer. For example, in the case of a woven synthetic material, the surface to be modified may be partially melted in order to provide a smoother surface.

FIG. 6 depicts a first example of a glove with a sliding interface provided between the inner layer 1 and the padding layer 3. In order to provide the sliding interface, an intermediate layer of material 4 is provided between the inner layer 1 and the padding layer 3. The intermediate layer 4 may not be visible to the wearer of the glove. Accordingly, the intermediate layer 4 need not be formed from a material selected for qualities that may usually be desirable for material used to form a glove. The material forming the intermediate layer 4 may be selected in order to have low friction between the intermediate layer 4 and at least one of the inner layer 1 and padding layer 3 at the respective interface 10, 11 between the intermediate layer 4 and the inner layer 1 and/or padding layer 3. Such an arrangement enables sliding between the inner layer 1 and the padding layer 3, and therefore between the inner layer 1 and the outer layer 2.

It should be appreciated that, for clarity, in FIG. 6 a separation is shown between the layers 1, 3, 4, namely at the interfaces 10, 11. In practice these layers may be touching, at least in some regions, especially in use. In some arrangements, the intermediate layer 4 may be fixed to one of the adjacent layers and slide relative to the other.

FIG. 7 depicts an alternative arrangement of a sliding interface. As with the arrangement depicted in FIG. 6, a sliding interface is provided between the inner layer 1 and the padding layer 3. In this arrangement, the sliding interface is formed from first and second intermediate layers 4A, 4B provided between the inner layer 1 and the padding layer 3. In such an arrangement, the first and second intermediate layers 4A, 4B may be selected for the low friction between the first and second intermediate layers 4A, 4B, namely at the interface 12 between them. Alternatively and/or additionally, the interface 10 between the inner layer 1 and first intermediate layer 4A and/or the interface 11 between the padding layer 3 and the second intermediate layer 4B may be low friction.

In an arrangement such as that shown in FIG. 4, the first and second intermediate layers 4A, 4B, may be formed from the same material or may be formed from different materials. Further intermediate layers may also be included, either to further promote sliding between any adjacent pair of layers and/or to provide additional properties to the glove overall.

In the arrangements shown in FIG. 6 and FIG. 7 and discussed above, the intermediate layers 4, 4A, 4B, where used, may be formed from any suitable material. For example these layers may be formed from films of plastic that may be formed to have smooth surfaces. It should also be appreciated that the arrangements depicted in the Figures are schematic and, accordingly, the relative thicknesses of the different layers shown in the figures may not be representative.

FIG. 8 depicts a further arrangement for providing a sliding interface to the glove. In this arrangement, the sliding interface is formed by modifying the surface of at least one of the inner layer 1 and padding layer 3. The friction at the interface 13 in between the modified surface 21 of the inner layer 1 and the modified surface 31 of the padding layer 3 may be lower than the friction that would occur between the unmodified surfaces of the inner layer 1 and padding layer 3.

Depending on the modified surface, it may be sufficient that the surface of only one of the inner layer 1 and padding layer 3 be modified.

It should be appreciated that this arrangement may be combined with those discussed above, namely by providing one or more intermediate layers 4 between the modified surfaces 21, 31 of the inner layer 1 and padding layer 3 in order to promote further the low friction interface.

It should also be appreciated that instead of modifying the surfaces of the inner layer 1 and/or padding layer 3, the materials forming the inner layer 1 and/or padding layer 3 may be selected such that there is sufficiently low friction between the opposing surfaces of the inner layer 1 and padding layer 3 to provide a low friction interface.

A variety of modifications may be used in order to modify the surfaces 21, 31 of the inner layer 1 and padding layer 3. It should also be appreciated that a different modification may be used for the inner layer 1 from the modification used for the padding layer 3. By way of example, the surface of a layer may be modified by impregnating a different substance into the surface of the layer. Alternatively or additionally, a different substance may be bonded to the surface of the layer. Alternatively or additionally, a physical treatment may be applied to the surface of the layer. For example, in the case of a woven synthetic material, the surface to be modified may be partially melted in order to provide a smoother surface.

Figure 2:
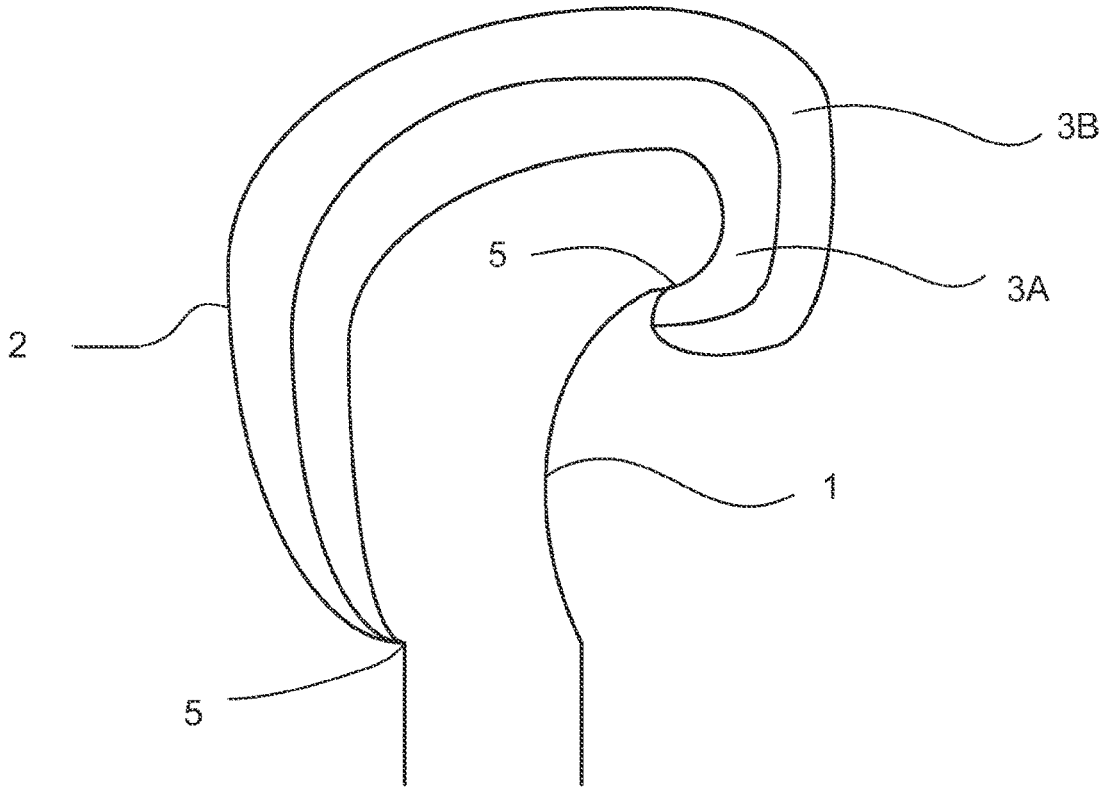
FIG. 2 depicts a cross-section of a second example glove.

A second example glove is shown in FIG. 2. This example glove is identical to the first example glove depicted in FIG. 1, however, between the inner and outer layers 1, 2 are first and second padding layers 3A, 3B. The first and second padding layers 3A and 3B are configured to absorb and/or redirect energy of an impact between the glove and an object. The first and second padding layers 3A, 3B may be formed from the same material or different materials.

As in the first example glove, the second example glove further comprises a sliding interface between the inner layer and the outer layer at which the inner layer and outer layer are configured to slide relative to each other in response to an impact between the glove and an object. However, in this example, a sliding interface is provided between the first and second padding layers 3A, 3B. Various examples of sliding interfaces for the glove depicted in FIG. 1 are shown in FIGS. 9 to 11 and are described below.

Figure 9:
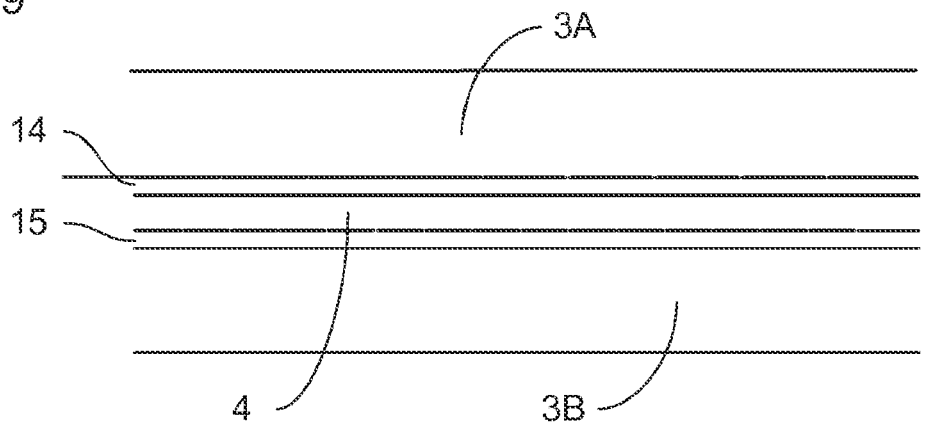
FIG. 9 depicts a cross-section of a portion of a glove.

FIG. 9 depicts a first example of a glove with a sliding interface provided between the first and second padding layers 3A, 3B. In order to provide the sliding interface, an intermediate layer of material 4 is provided between the first and second padding layers 3A, 3B. The intermediate layer 4 may not be visible to the wearer of the glove. Accordingly, the intermediate layer 4 need not be formed from a material selected for qualities that may usually be desirable for material used to form a glove. The material forming the intermediate layer 4 may be selected in order to have low friction between the intermediate layer 4 and at least one of the first and second padding layers 3A, 3B at the respective interface 14, 15 between the intermediate layer 4 and the first and/or second padding layers 3A, 3B. Such an arrangement enables sliding between the first and second padding layers 3A, 3B, and therefore between the inner layer 1 and the outer layer 2.

It should be appreciated that, for clarity, in FIG. 9 a separation is shown between the layers 3A, 3B, 4, namely at the interfaces 14, 15. In practice these layers may be touching, at least in some regions, especially in use. In some arrangements, the intermediate layer 4 may be fixed to one of the adjacent layers and slide relative to the other.

Figure 10:
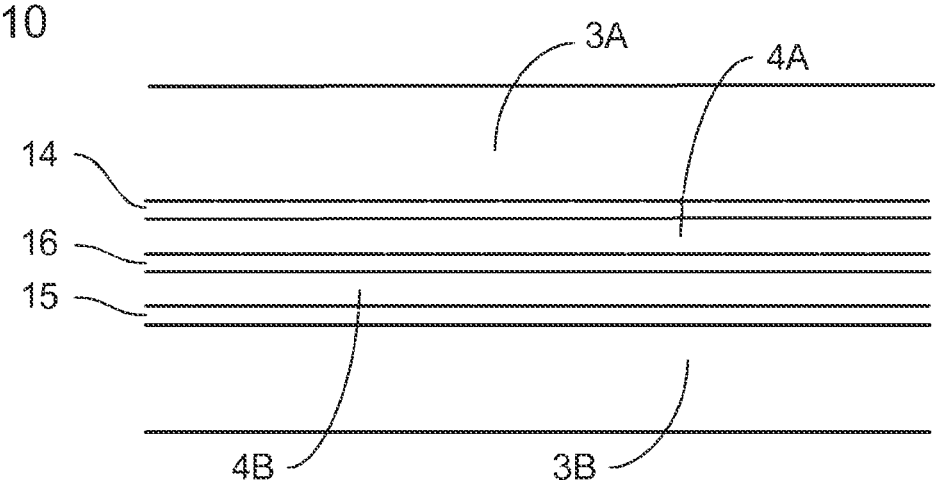
FIG. 10 depicts a cross-section of a portion of a glove.
Figure 11:
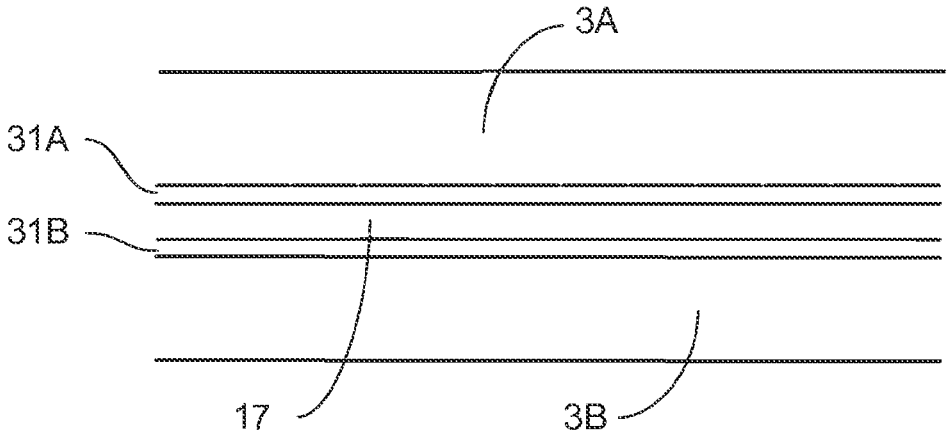
FIG. 11 depicts a cross-section of a portion of a glove.

FIG. 10 depicts an alternative arrangement of a sliding interface. As with the arrangement depicted in FIG. 9, a sliding interface is provided between the first and second padding layers 3A, 3B. In this arrangement, the sliding interface is formed from first and second intermediate layers 4A, 4B provided between the first and second padding layers 3A, 3B. In such an arrangement, the first and second intermediate layers 4A, 4B may be selected for the low friction between the first and second intermediate layers 4A, 4B, namely at the interface 16 between them. Alternatively and/or additionally, the interface 14 between the first padding layer 3A and first intermediate layer 4A and/or the interface 15 between the second padding layer 3B and the second intermediate layer 4B may be low friction.

In an arrangement such as that shown in FIG. 4, the first and second intermediate layers 4A, 4B, may be formed from the same material or may be formed from different materials. Further intermediate layers may also be included, either to further promote sliding between any adjacent pair of layers and/or to provide additional properties to the glove overall.

In the arrangements shown in FIG. 9 and FIG. 10 and discussed above, the intermediate layers 4, 4A, 4B, where used, may be formed from any suitable material. For example these layers may be formed from films of plastic that may be formed to have smooth surfaces. It should also be appreciated that the arrangements depicted in the Figures are schematic and, accordingly, the relative thicknesses of the different layers shown in the figures may not be representative.

FIG. 11 depicts a further arrangement for providing a sliding interface to the glove. In this arrangement, the sliding interface is formed by modifying the surface of at least one of the first and second padding layers 3A, 3B. The friction at the interface 17 in between the modified surface 31A of the first padding layer 3A and the modified surface 31B of the second padding layer 3A may be lower than the friction that would occur between the unmodified surfaces of the first and second padding layers 3A, 3B.

Depending on the modified surface, it may be sufficient that the surface of only one of the first and second padding layers 3A, 3B be modified.

It should be appreciated that this arrangement may be combined with those discussed above, namely by providing one or more intermediate layers 4 between the modified surfaces 31A, 31B of the first and second padding layers 3A, 3B in order to promote further the low friction interface.

It should also be appreciated that instead of modifying the surfaces of the first and second padding layers 3A, 3B, the materials forming the first and second padding layers 3A, 3B may be selected such that there is sufficiently low friction between the opposing surfaces of the first and second padding layers 3A, 3B to provide a low friction interface.

A variety of modifications may be used in order to modify the surfaces 31A, 31B of the first and second padding layers 3A, 3B. It should also be appreciated that a different modification may be used for the first padding layer 3A from the modification used for the second padding layer 3B. By way of example, the surface of a layer may be modified by impregnating a different substance into the surface of the layer. Alternatively or additionally, a different substance may be bonded to the surface of the layer. Alternatively or additionally, a physical treatment may be applied to the surface of the layer. For example, in the case of a woven synthetic material, the surface to be modified may be partially melted in order to provide a smoother surface.

In the preceding description, reference has been made to the provision of a low friction sliding interface. It should be appreciated that the level of friction necessary to constitute low friction may vary. However, in this context, it is meant a level of friction between the respective layers that ensures that the layers may slide relative each other under the loading that may be expected for a glove used for punching. In some uses of the invention, it may be desirable to configure the low friction interface such that the coefficient of friction is between 0.001 and 0.3 and/or below 0.15.

In an example, at least one of the materials used to form the inner and outer layers 1, 2 may be stretchable. This may enable a region of one of the inner and outer layers 2, 3 to slide relative to the other of the layers, even if the edges of the first and second layers are secured relative to each other, for example, where a section of the layer is secured to another component, e.g. the other of the inner and outer layers 1, 2. In such a condition, a part of one of the layers may be stretched on one side of the region that is sliding.

Accordingly, at least one of the inner and outer layers 1, 2 may be formed from an elastic material configured to stretch elastically in response to an impact between the glove and an object to allow the inner layer and the outer layer to slide relative to each other.

Alternatively or additionally, at least one of the materials used to connect the inner and outer layers 1, 2 may be stretchable. Accordingly, the inner and outer layers 1, 2 may be connected by an elastic connecting means configured to stretch elastically in response to an impact between the glove and the object to allow the inner layer and the outer layer to slide relative to each other. For example, the seams 5 may be stitched using a stretchable material.

Although the above description has referred to the layers as if they are formed of a single material, it should be appreciated that these layers may themselves may be formed from multiple layers of materials For example, the inner and/or outer layers 1, 2 may be formed from a fabric substrate (or any other example material described above) coated with plastic or rubber.

The layers may be formed from different materials in different regions. In another example, a central portion of the inner and/or outer layers 1, 2 may be formed from a relatively inelastic material (e.g. leather) and a peripheral portion, e.g. surrounding the central portion, may be formed from a relatively elastic material (e.g. Lycra™) Accordingly, the central portion may be allowed to move relative to the peripheral portion (and slide relative to an adjacent layer), by the elastic stretching of the peripheral portion.

Figure 12:
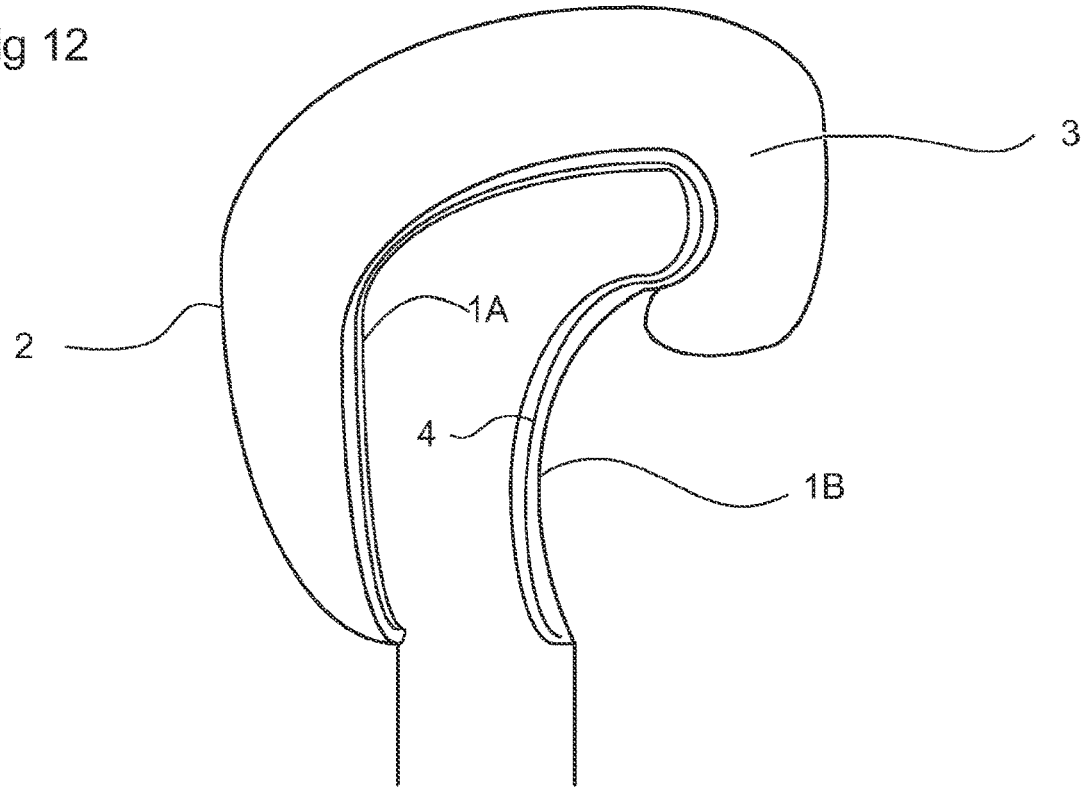
FIG. 12 depicts a cross-section of a third example glove.

A third example glove is shown in FIG. 12. In this example glove, the inner layer 1 has a multi-layered structure. A sliding interface is provided between respective layers of the inner layer 1. Further, the inner layer 1 may be unattached to the rest of the glove, such that it can be selectively removed from and inserted into the cavity formed by the padding layer 3. The inner layer 1 may be provided in the form of an inner-glove or inner-mitten worn by the wearer of the glove.

The inner layer 1 of the third example glove may comprise an inner-inner layer 1A and an outer-inner layer 1B. One or more intermediate layers 4 may be provided between the inner-inner layer 1A and the outer-inner layer 1B. The arrangement and function of the multiple layers of the inner layer 1 may be analogous to the multiple layers described above in relation to FIGS. 6 to 8, with the inner and padding layers 1, 3 corresponding to the inner-inner layer 1A and outer-inner layer 1B respectively.

The materials forming the inner-inner layer 1A and outer-inner layer 1B may be formed from a textile, a cloth and/or a fabric. However, other materials may also be used, including felts and directly-formed flexible sheet materials including, for example, artificial leather.

It should be appreciated that the inner-inner layer 1A and outer-inner layer 1B may be different and/or different types. Accordingly, the layer of material to be provided on the inside of the inner layer 1 may be selected for one particular quality, such as comfort for the wearer, while a second material may be selected for the layer to be formed on the outside of the inner layer 1, for example for its appearance. Both layers may be formed from the same material.

The material may be configured to include perforations and/or ventilation holes. In general, the inner layer 1 may be configured, by use of such perforations and/or ventilation holes and/or by selection of the substances used to form the material, to ensure that heat and/or sweat can be transferred away from the hand of the wearer.

At least one of the inner-inner layer 1A and outer-inner layer 1B may be selected to be stretchable, which may help in ensuring that a region of the inner-inner layer 1A and outer-inner layer 1B are slidable relative to each other. Use of such material may also ensure that the inner layer 1 overall is stretchable and thereby may provide a comfortable but secure fit to a variety of hand sizes.

In an arrangement, the material used to form the inner layer 1 may have a total thickness of from 0.1 mm to 20 mm.

Figure 13:
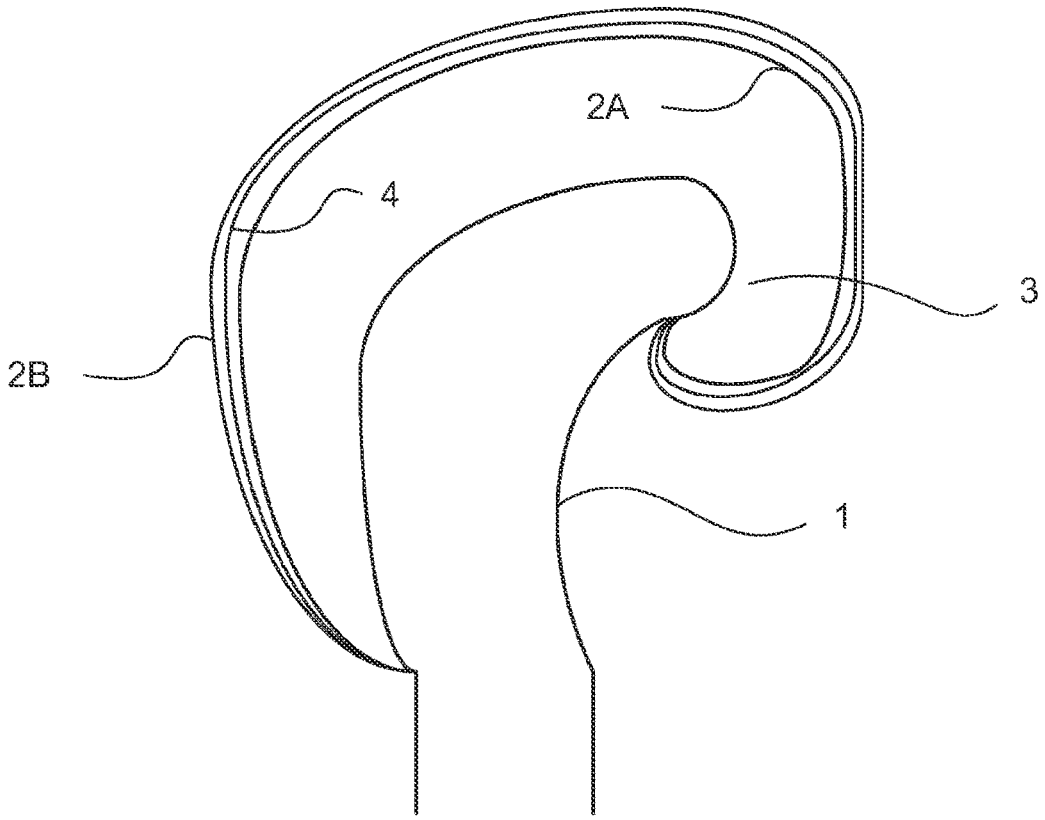
FIG. 13 depicts a cross-section of a fourth example glove.

A fourth example glove is shown in FIG. 13. In this example glove, the outer layer 2 has a multi-layered structure. A sliding interface is provided between respective layers of the outer layer 2. Further, the outer layer 2 may be unattached to the rest of the glove, such that the rest of the glove can be selectively removed from and inserted into the cavity formed by the outer layer 2.

The outer layer 2 of the fourth example glove may comprise an inner-outer layer 2A and an outer-outer layer 2B. One or more intermediate layers 4 may be provided between the inner-outer layer 2A and the outer-outer layer 2B. The arrangement and function of the multiple layers of the outer layer 2 may be analogous to the multiple layers described above in relation to FIGS. 3 to 5, with the padding and outer layers 3, 2 corresponding to the inner-outer layer 2A and outer-outer layer 2B respectively.

The materials forming the inner-outer layer 2A and outer-outer layer 2B may be the same as described above in relation to the inner-inner layer 1A and outer-inner layer 1B respectively.

Figure 14:
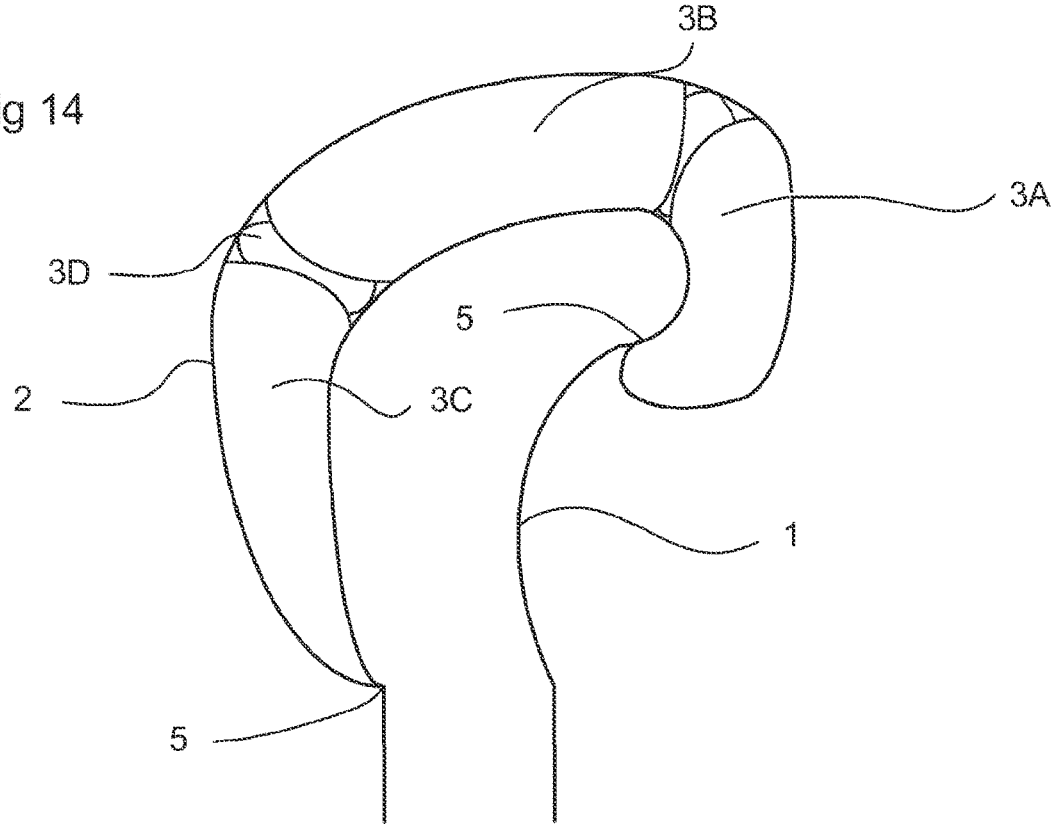
FIG. 14 depicts a cross-section of a fifth example glove.

A fifth example glove is shown in FIG. 14. In this example glove the padding layer comprises a plurality of padding segments 3C-E, each padding segment 3C-E being configured to slide relative to the inner and/or outer layers 1, 2 at a sliding interface and each padding segment 3C-E being configured to slide independently of each other padding segment 3C-E.

The padding layer 3 may comprise at least two padding segments connected to each other by a connector 3F configured to allow relative movement between the two padding segments.

As in the example shown in FIG. 14, the connector 3F may be a separate component to the at least two padding segments. The connector 3F may be arranged between the at least two padding segments. The connector 3F may comprise a resilient structure.

In a variation of the fifth example, the connector 3F may be an integral part of the padding layer co-formed with the at least two padding segments, between the at least two padding segments. The connector 3F may be formed so as to have a lower stiffness than the at least two padding segments so as to allow the at least two padding segments to move relative to each other.

For example, the connector 3F may comprise apertures in the padding layer forming the part of the padding layer configured to provide the lower stiffness of the connector compared to the at least two padding segments, wherein the material of the padding layer defining the apertures forms a resilient structure.

Figure 15:
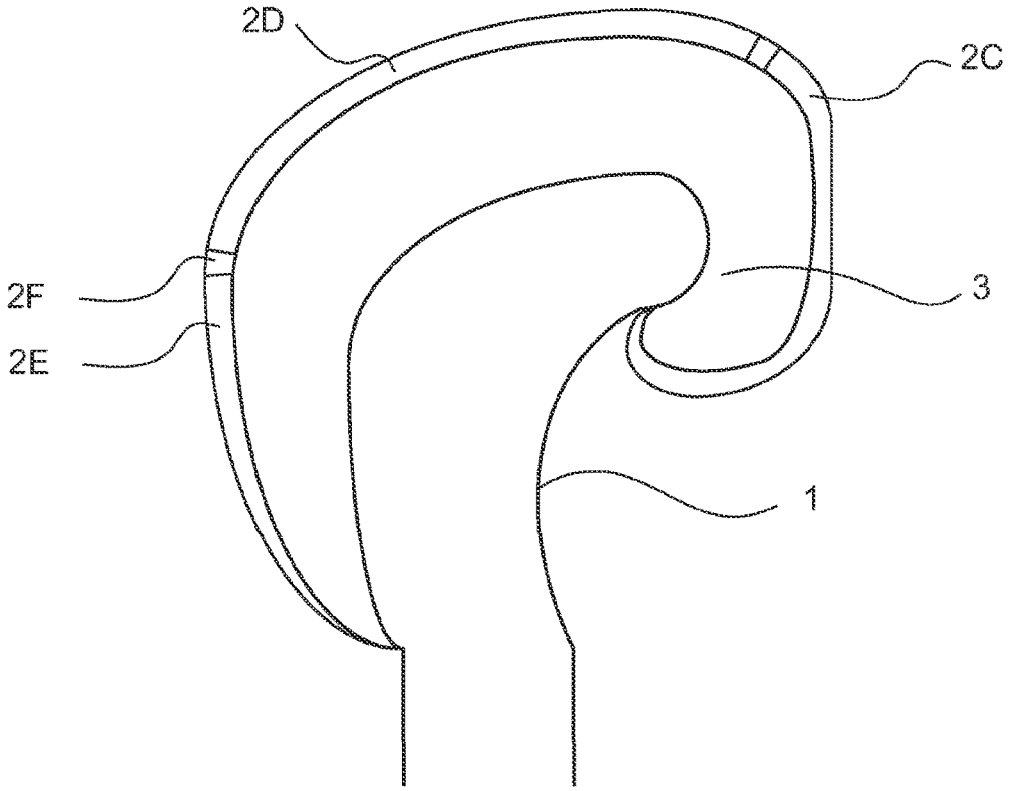
FIG. 15 depicts a cross-section of a sixth example glove.

A sixth example glove is shown in FIG. 15. In this example glove, the outer layer 2 comprises a plurality of outer layer segments 2C-E, each outer layer segment 2C-E being configured to slide relative to the padding layer 3 and/or inner layer 1 at a sliding interface and each outer layer segment 2C-E being configured to slide independently of each other outer layer segment 2C-E.

The outer layer 2 may comprise at least two outer layer segments connected to each other by a connector 2F configured to allow relative movement between the two outer layer segments.

As in the example shown in FIG. 15, the connector may be a separate component to the at least two outer layer segments. The connector may be arranged between the at least two outer layer segments. The connector 2F may comprise a resilient structure.

In a variation of the sixth example, the connector 2F may be an integral part of the outer layer co-formed with the at least two outer layer segments, between the at least two outer layer segments. The connector 2F may be formed so as to have a lower stiffness than the at least two outer layer segments so as to allow the at least two outer layer segments to move relative to each other.

For example, the connector 2F may comprise apertures in the outer layer forming the part of the outer layer configured to provide the lower stiffness of the connector 2F compared to the at least two outer layer segments, wherein the material of the padding layer defining the apertures forms a resilient structure.

Figure 16:
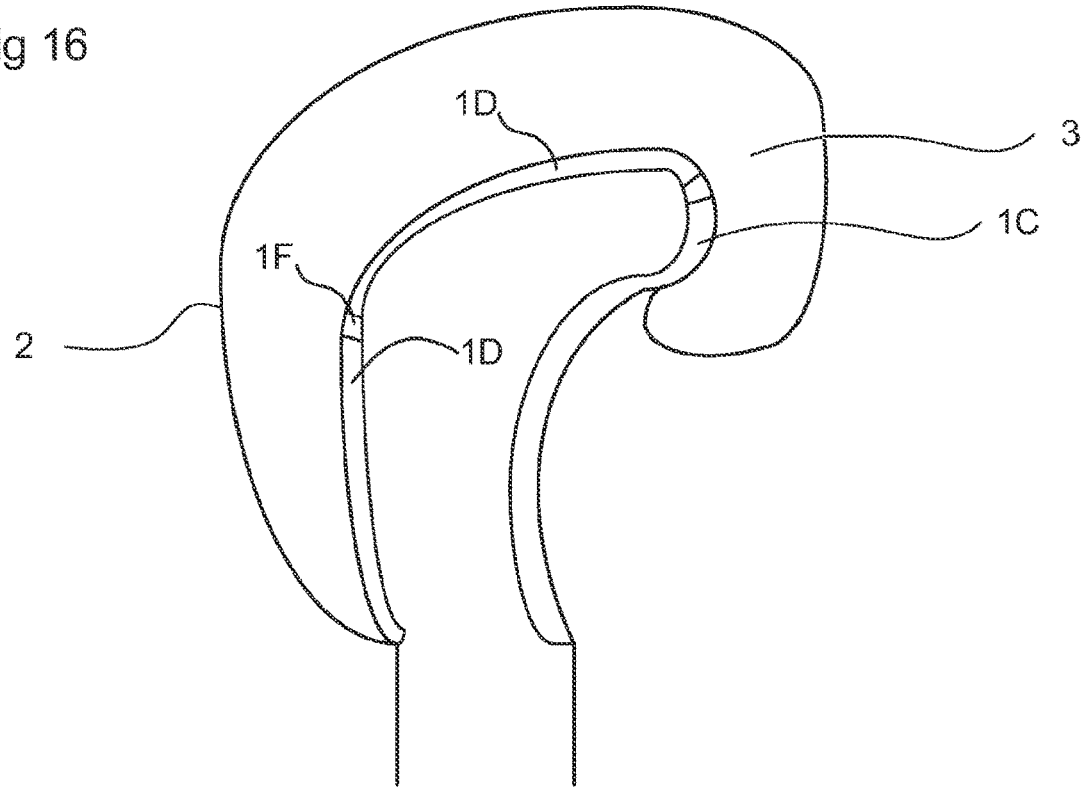
FIG. 16 depicts a cross-section of a seventh example glove.

A seventh example glove is shown in FIG. 16. In this example glove, the inner layer 1 comprises a plurality of inner layer segments 1C-E, each inner layer segment 1C-E being configured to slide relative to the padding layer 3 and/or outer layer 2 at a sliding interface and each inner layer segment 1C-E being configured to slide independently of each other outer layer segment 1C-E.

The inner layer 1 may comprise at least two inner layer segments connected to each other by a connector 1F configured to allow relative movement between the two inner layer segments.

As in the example shown in FIG. 15, the connector 1F may be a separate component to the at least two inner layer segments. The connector 1F may be arranged between the at least two inner layer segments. The connector 1F may comprise a resilient structure.

In a variation of the seventh example, the connector 1F may be an integral part of the inner layer co-formed with the at least two inner layer segments, between the at least two inner layer segments. The connector 1F may be formed so as to have a lower stiffness than the at least two inner layer segments so as to allow the at least two inner layer segments to move relative to each other.

For example, the connector 1F may comprise apertures in the inner layer forming the part of the inner layer configured to provide the lower stiffness of the connector 1F compared to the at least two inner layer segments, wherein the material of the padding layer defining the apertures forms a resilient structure.

In the above examples, segments should not be confused with layers. Whereas the layers are provided substantially adjacent each other in a thickness direction of the glove, in contrast, the segments are substantially provided adjacent each other in a direction substantially perpendicular to the thickness direction of the glove.

Figure 17:
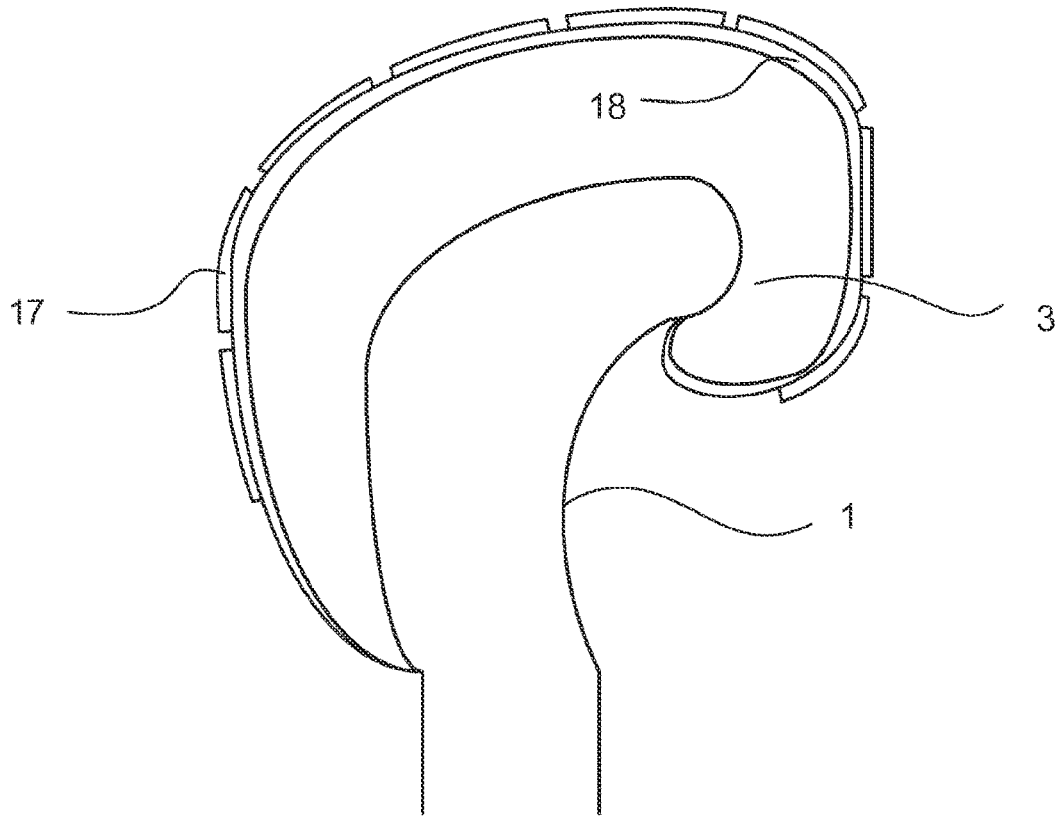
FIG. 17 depicts a cross-section of a eighth example glove.

An eighth example glove is shown in FIG. 17. In the seventh example glove, the outer layer 2 is formed from a plurality of outer plates 17. The outer plates 17 are mounted on the padding layer 3 such that, under an impact to an outer plate 17, the outer plate 17 can slide across the relatively padding layer 3 and move relative to other outer plates 17.

A low friction interface may be provided between the outer surface of the padding layer and at least a part of the surface of the outer plates 17 that is in contact with the outer surface of the padding layer under an impact to an outer plate 17. The low friction interface may be provided by an intermediate layer 18 formed form a material that is relatively hard compared to the padding layer 3.

The glove may comprise at least one connector (not shown) associated with each outer plate 17, configured to secure the outer plate 17 to at least one of the padding layer and the intermediate layer 14 in the absence of an impact.

The connector may be configured to deform under an impact to the outer plate associated with the connector, e.g. elastically. Alternatively, or additionally, the connector may be configured to rupture under an impact to the outer plate 17 associated with the connector.

Figure 18:
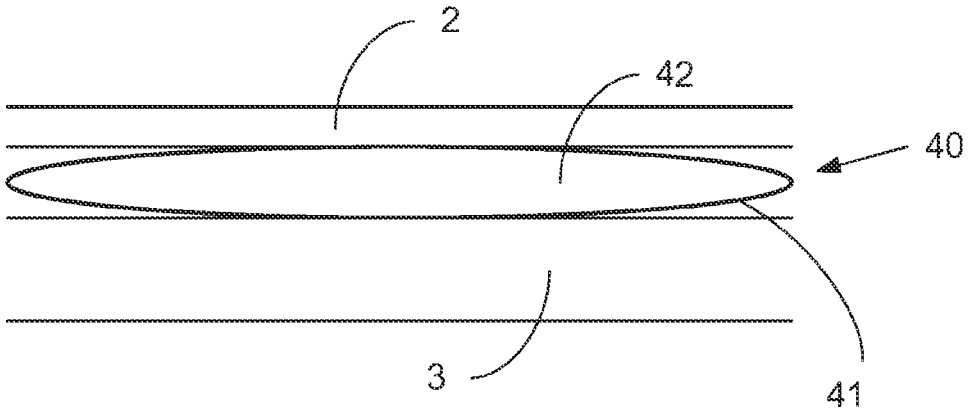
FIG. 18 depicts a cross-section of a ninth example glove.

A ninth example glove is shown in FIG. 18. In this example, the intermediate layer 4 may be provided in the form of a fluid filled envelope 40. The fluid filled envelope 40 may comprise walls 41 surrounding a central region 42 filled with a fluid. The walls 41 may be formed from a flexible and/or elastic material, such as rubber or plastic. Opposing internal walls 41 of the envelope 40 are configured to slide relative to each other, thus providing a sliding interface there between. The fluid may be configured to reduce friction at the sliding interface. The fluid may be a liquid or a gel, for example. The fluid may comprise silicone. The fluid may be an oil, such as vegetable oil.

As the inner and outer layers of the glove move relative each other, so opposing walls of the envelope move relative each other. The envelope may be secured to one or both adjacent layers of the glove. Alternatively, the envelope may be free to move within the space between the layers. Multiple relatively small envelopes 40 may be provided within the glove. Alternatively, one (e.g. relatively large) envelope 40 may be provided.

In this example, the fluid filled envelope is provided between the outer layer 2 and the padding layer. However, the envelope may be provided between any sliding layers described above.

Variations of the above described embodiments are possible in light of the above teachings. It is to be understood that the invention may be practised otherwise than specifically described herein without departing from the spirit and scope of the invention.

The invention claimed is:

1. A combat sports glove, comprising:

an inner layer configured to accommodate a wearer's hand;

an outer layer covering at least a part of the inner layer;

a padding layer between the inner and outer layers, configured to absorb and/or redirect energy of an impact between the glove and an object; and a sliding interface between the inner layer and the outer layer at which the inner layer and the outer layer are configured to slide relative to each other in response to an impact between the glove and an object;

wherein the sliding interface comprises a modification of the surface of at least one of the inner, outer and padding layers such that there is low friction between that surface and an adjacent layer, and either said modification of the surface comprises the use of a different substance from that used to form the inner, outer or padding layer, impregnated into the surface of the inner, outer or padding layer or bonded to the inner, outer or a padding layer, or said modification of the surface comprises a physical treatment to the surface of at least one of the inner, outer, and padding layers in order to change the mechanical properties of the surface of the layer.

2. The combat glove of claim 1, wherein at least one of the inner and outer layers is formed from an elastic material configured to stretch elastically in response to an impact between the glove and an object to allow the inner layer and the outer layer to slide relative to each other.

3. The combat glove of claim 1, wherein the inner and outer layers are connected by an elastic connecting means configured to stretch elastically in response to an impact between the glove and the object to allow the inner layer and the outer layer to slide relative to each other.

4. The combat glove of claim 1, wherein the sliding interface comprises an intermediate layer formed from a material selected such that there is low friction between the intermediate layer and at least one adjacent layer.

5. The combat glove of claim 1, wherein the sliding interface comprises first and second intermediate layers, arranged adjacent each other and each formed from a material selected such that there is low friction at least between the first and second intermediate layers.

6. The combat glove of claim 1, wherein the sliding interface is provided between the outer layer and the padding layer.

7. The combat glove of claim 1, wherein the sliding interface is provided between the inner layer and the padding layer.

8. The combat glove of claim 1, wherein the padding layer comprises first and second padding layers and the sliding interface is provided between the first and second padding layers.

9. The combat glove of claim 1, wherein the inner layer has a multi-layered structure and the sliding interface is provided between respective layers of the inner layer.

10. The combat glove of claim 1, wherein the outer layer has a multi-layered structure and the sliding interface is provided between respective layers of the outer layer.

11. The combat glove of claim 1, wherein the padding layer comprises a plurality of padding segments, each padding segment being configured to slide relative to the inner and/or outer layers at a sliding interface and each padding segment being configured to slide independently of each other padding segment.

12. The combat glove of claim 1, wherein the outer layer comprises a plurality of outer layer segments, each outer layer segment being configured to slide relative to the padding and/or inner layers at a sliding interface and each outer layer segment being configured to slide independently of each other outer layer segment.

13. The combat glove of claim 1, wherein the inner layer comprises a plurality of inner layer segments, each inner layer segment being configured to slide relative to the padding and/or outer layers at a sliding interface and each inner layer segment being configured to slide independently of each other inner layer segment.

14. The combat glove of claim 1, wherein the outer layer comprises a plurality of outer plates, the outer plates being mounted on the padding layer such that, under an impact to an outer plate, the outer plate can slide across the relatively padding layer and move relative to other outer plates.

15. The combat glove of claim 1, comprising a fluid filled envelope between the inner and outer layers configured to provide the sliding interface.

* * * * *